US007972049B2

(12) United States Patent
Sugie

(10) Patent No.: US 7,972,049 B2
(45) Date of Patent: Jul. 5, 2011

(54) VEHICLE LIGHTING DEVICE

(75) Inventor: Yoshihiro Sugie, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 0 days.

(21) Appl. No.: 12/689,760

(22) Filed: Jan. 19, 2010

(65) Prior Publication Data

US 2010/0195345 A1 Aug. 5, 2010

(30) Foreign Application Priority Data

Feb. 3, 2009 (JP) ..... 2009-023043

(51) Int. Cl.
*F21V 33/00* (2006.01)

(52) U.S. Cl. ..... 362/545; 362/547; 362/249.02

(58) Field of Classification Search ..... 362/249.02, 362/543, 544, 545, 547
See application file for complete search history.

(56) References Cited

U.S. PATENT DOCUMENTS 7,201,506 B2 * 4/2007 Ishida et al. ..... 362/544
7,201,507 B2 * 4/2007 Takeda et al. ..... 362/545
7,513,659 B2 * 4/2009 Vukosic et al. ..... 362/373
7,553,054 B2 6/2009 Yagi
7,597,465 B2 10/2009 Inaba et al.
2006/0239022 A1 10/2006 Inaba et al.
2007/0279924 A1 12/2007 Yagi
2009/0251916 A1 * 10/2009 Tanaka et al. ..... 362/538

FOREIGN PATENT DOCUMENTS

JP 2006-302711 A 11/2006
JP 2007-323885 A 12/2007

* cited by examiner

*Primary Examiner* — Laura Tso
(74) *Attorney, Agent, or Firm* — Foley & Lardner LLP

(57) ABSTRACT

A vehicle lighting device is provided, and includes a mount member, a semiconductor-type light source, a reflector, and screws. Mounting boss portions in which the screws are to be threaded are provided at the mount member. At the reflector, through holes into which the screws are to be inserted are provided for the mounting boss portions. A hollow axle portion, which rotatably engages with one of the mounting boss portions from the outside, is provided at an edge of one of the through holes of the reflector. As a result, this vehicle lighting device allows the reflector to be mounted on the mount member having the semiconductor-type light source mounted thereon, without the semiconductor-type light source and the reflector interfering with each other.

7 Claims, 7 Drawing Sheets

VEHICLE LIGHTING DEVICE

CROSS-REFERENCE TO RELATED APPLICATIONS

This application claims priority of Japanese Patent Application No. 2009-023043 filed on Feb. 3, 2009. The contents of this application are incorporated herein by reference in their entirety.

BACKGROUND OF THE INVENTION

1. Field of the Invention

The present invention relates to a vehicle lighting device using a semiconductor-type light source such as an LED, for example, as a light source.

2. Description of the Related Art

A vehicle lighting device of this type is conventionally known (Japanese Laid-open Patent Application Nos. 2007-323885 and 2006-302711, for example). Hereinafter, the conventional vehicle lighting device will be described. The conventional vehicle lighting device is provided with: a mount member; and a semiconductor-type light source and a reflector, which are mounted on the mount member. When the semiconductor-type light source is lit, the light from the semiconductor-type light source is reflected in a predetermined direction in a predetermined light distribution pattern, by means of a reflecting surface of the reflector, and is then illuminated to the outside.

In the conventional vehicle lighting device described previously, it has been important that the semiconductor-type light source and the reflector are disallowed to interfere with each other, when the semiconductor-type light source is mounted on the mount member and when the reflector is mounted on the mount member.

The present invention has been made in view of the above-described importance, and aims to provide a vehicle lighting device disallowing a semiconductor-type light source and a reflector to interfere with each other, when the semiconductor-type light source is mounted on a mount member and when the reflector is mounted on the mount member.

SUMMARY OF THE INVENTION

A first aspect of the present invention is directed to a vehicle lighting device, comprising:

(i) a mount member;

(ii) a semiconductor-type light source which is mounted on the mount member;

(iii) a reflector which is mounted on the mount member, the reflector having a reflecting surface for reflecting light from the semiconductor-type light source in a predetermined direction in a predetermined light distribution pattern; and (iv) at least two screws for mounting the reflector on the mount member by threading the screws into the mount member in an identical direction via the reflector, wherein:

at least two mounting boss portions into which the screws are to be threaded are provided at the mount member;

at least two through holes into which the screws are to be inserted are provided for the mounting boss portions at the reflector; and a hollow axle portion which rotatably engages with at least one of the mounting boss portions from an outside is provided at an edge of at least one of the through holes of the reflector.

A second aspect of the present invention is directed to the vehicle lighting device according to the first aspect, wherein:

a positioning end face abutting against the mount member to thereby determine a position of the reflector relative to the mount member is provided at the hollow axle portion.

A third aspect of the present invention is directed to the vehicle lighting device according to the first or second aspect, wherein:

positioning portions for determining positions in a screw-in rotation direction of the screws are provided at the mounting boss portion other than the mounting boss portion with which the hollow axle portion engages and the reflector, respectively.

A fourth aspect of the present invention is directed to a vehicle lighting device, comprising:

(i) a semiconductor-type light source;

(ii) a heat sink member on which a mount visor portion having the semiconductor-type light source installed on a surface thereof and a respective one of first and second mounting boss portions are protruded in a predetermined direction; and (iii) a reflector which is mounted on the heat sink member in the predetermined direction, the reflector having a reflecting surface including an overlap portion between the reflector and the semiconductor-type source installed on the mount visor portion, in a case where the reflector is directly seen in a direction orthogonal to the predetermined direction when the reflector is mounted on the heat sink, the reflecting surface being adapted to reflect light emitted from the semiconductor-type light source installed on the mount visor portion, as reflection light, the reflector including:

through holes which are provided at positions corresponding to the first and second mounting boss portions of the heat sink member and into which screws are to be inserted; and a hollow axle portion which is provided at an edge of either of the through holes and is adapted to rotatably engage with either of the first and second mounting boss portions of the heat sink member from an outside, in a state in which the reflector is inclined against the heat sink member.

A fifth aspect of the present invention is directed to the vehicle lighting device according to the fourth aspect, wherein:

a positioning end face abutting against the mount member to thereby determine a position of the reflector relative to the mount member is provided at the hollow axle portion of the reflector.

A sixth aspect of the present invention is directed to the vehicle lighting device according to the fourth aspect, wherein:

positioning portions for determining positions in a screw-in rotation direction of the screws are provided at the mounting boss portion other than the mounting boss portion with which the hollow axle portion engages and at the reflector, respectively.

A seventh aspect of the present invention is directed to the vehicle lighting device according to the fourth aspect, wherein:

the reflector has a cylinder portion, which is provided for the first and second mounting boss portions of the heat sink member, on a face opposite to the reflecting surface of the reflector; and the through hole of the reflector is formed in the cylinder portion.

In the vehicle lighting device according to the first aspect of the present invention, as shown in FIGS. 8 and 9, it is structurally impossible to mount a reflector in five directions (upward direction U, downward direction D, leftward direction L, rightward direction R, backward direction B) when the reflector is mounted on a mount member having a semiconductor-type light source mounted thereon, and it is possible to mount the reflector in one direction (forward direction F). In addition, as shown in FIG. 6, in a vehicle lighting device in which an overlap portion exists between the semiconductor-type light source and the reflector, when the reflector is mounted on the mount member having the semiconductor-type light source mounted thereon in one direction (forward direction F), the reflector can be mounted thereon without the semiconductor-type light source and the reflector interfering with each other at the time of the mounting. In other words, in the vehicle lighting device according to the first aspect of the present invention, when a reflector is mounted on the mount member having the semiconductor-type light source mounted thereon in one direction (forward direction F), without the semiconductor-type light source and the reflector interfering with each other, as shown in FIGS. 2 and 4, the reflector is inclined against a mount member having a semiconductor-type light source mounted thereon; in this state, a hollow axle portion of the reflector is rotatably engaged with a mounting boss portion of the mount member in one direction (forward direction F) from the outside to thereby align at least one of the through holes of the reflector with at least one of the mounting boss portions of the mount member; next, the reflector is rotated around the hollow axle portion and the mounting boss portion in the direction indicated by the arrow of FIGS. 2 and 4 to thereby align at least the other one of the through holes of the reflector with at least the other one of the mounting boss portions; and in this state, at least two screws are inserted into the through holes of the reflector, and are then threaded into the mounting boss portions of the mount member, thereby allowing the reflector to be mounted on the mount member having the semiconductor-type light source mounted thereon, without the semiconductor-type light source and the reflector interfering with each other.

In addition, in the vehicle lighting device according to the second aspect of the present invention, in a state in which a hollow axle portion of a reflector is rotatably engaged with a mounting boss portion of a mount member from the outside, by means of a positioning end face provided at the hollow axle portion of the reflector, if the reflector is pushed into the mount member in one direction (forward direction F), the positioning end face of the hollow axle portion of the reflector is in abutment against a base of the mounting boss portion of the mount member, determining positions of the reflector and the mount member in one direction (forward direction F). As a result, the vehicle lighting device according to the second aspect of the present invention allows the reflector to be mounted, with high precision, on the mount member having the semiconductor-type light source mounted thereon.

Further, in the vehicle lighting device according to the third aspect of the present invention, by means of positioning portions provided on a mounting boss portion other than the one with which a hollow axle portion engages and a reflector, respectively, when a screw is inserted into a through hole of the reflector, and is then threaded into the mounting boss portion of a mount member, the positioning portion of the reflector is in abutment against the positioning portion of the mounting boss portion of the mount member in a screw thread-in (tightening) rotation direction, determining positions of the reflector and the mount member in the screw thread-in (tightening) rotation direction. As a result, the vehicle lighting device according to the third aspect of the present invention allows the reflector to be mounted, with high precision, on the mount member having the semiconductor-type light source mounted thereon.

DESCRIPTION OF THE PREFERRED EMBODIMENT(S)

Figure 1:
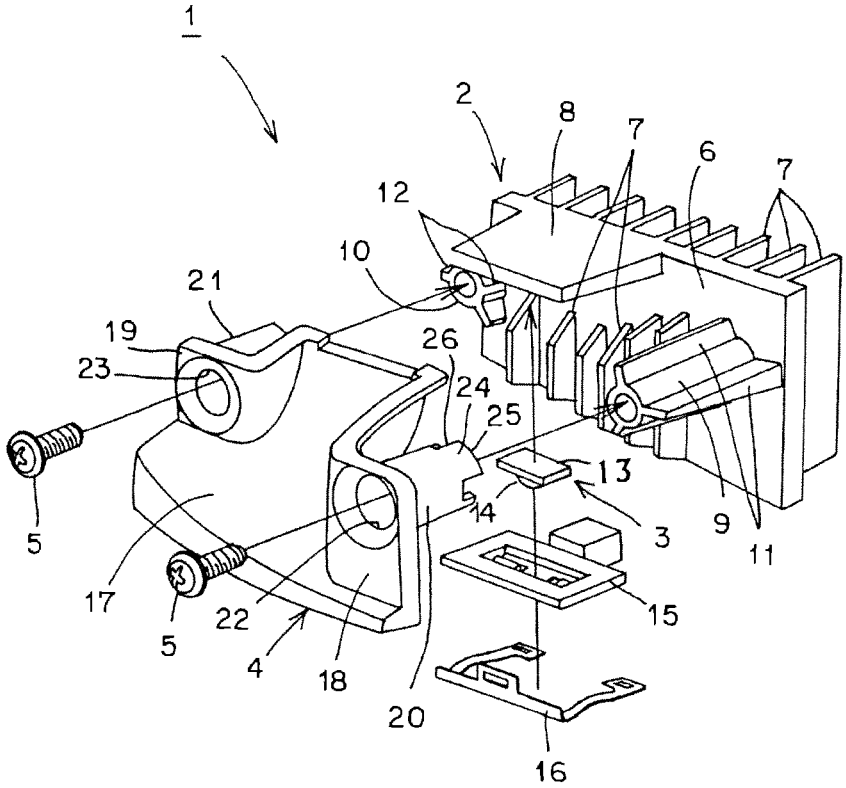
FIG. 1 is an exploded perspective view of essential portions showing an embodiment of a vehicle lighting device according to the present invention.

Hereinafter, an embodiment of a vehicle lighting device according to the present invention will be described in detail, referring to the drawings. This embodiment does not limit the present invention.

Embodiment(s)

Hereinafter, a constitution of the vehicle lighting device of the embodiment will be described. In the figures, reference numeral 1 designates the vehicle lighting device of the embodiment. The vehicle lighting device 1, as shown in FIG. 1, is made up of: a mount member 2; a semiconductor-type light source 3; a reflector 4; two screws 5; and a lamp housing and a lamp lens (such as a transparent outer lens, for example), although not shown.

The mount member 2, the semiconductor-type light source 3, the reflector 4, and the screws 5 constitute a lamp unit. The lamp unit are disposed solely or in plurality via an optical axle adjustment mechanism, for example, in a lamp room partitioned by the lamp housing and the lamp lens. In the lamp room, the other one or plural lamp units may also be disposed likewise.

The mount member 2 is made of a material with its high thermal conductivity, such as a resin or a metallic die cast, for example. The mount member 2 is made up of a mount board portion 6 serving as both of a heat sink member and a mount bracket.

On both faces (front and back faces) of the mount board portion 6, a plurality of heat radiation fins 7 are integrally provided in a vertical direction (longitudinal direction or upward-downward direction). In addition, at an intermediate portion of one long side (top side) of the mount board portion 6, a mount visor portion 8 is integrally protruded in one direction (forward direction). Further, at an intermediate portion of both sides (left and right sides) of one face (front face) of the mount board portion 6, two mounting boss portions 9, 10 into which the screws 5 are to be inserted are integrally protruded in one direction (forward direction). At the two mounting boss portions 9, 10, three ribs 11, 12 are integrally provided at equal intervals, respectively.

The semiconductor-type light source 3, for example, uses a self-luminous semiconductor-type light source such as an LED or an EL (organic EL). (The LED is used in the embodiment). The semiconductor-type light source 3 is made of: a board 13 as a thermally conductive insulation board (for example, ceramics); a light emitter (not shown) as a very small, rectangle-shaped (square-shaped) LED chip, which is provided on one face (bottom face) of the board 13; and a substantially hemispheric (dome-shaped) optical transmission member (lens) 14 covering the light emitter.

On one face (bottom face) of the mount visor portion 8 of the mount member (heat sink member-cum mount bracket) 2, the other face (top face) of the board 9 of the semiconductor-type light source 3 is mounted in one direction (downward direction), by means of a power feed holder 15 and a mount spring 16. The power feed holder 15 is intended to electrically connect a harness (not shown) having been electrically connected to a power source (not shown), via a connector (not shown), thereby feeding power to the semiconductor 3.

The reflector 4 is made up of an optically opaque resin member or the like. The reflector 4 is shaped to open in two directions (upward and forward directions) and to be closed in four directions (downward, backward, leftward, and rightward directions). On an interior face of a closed portion of the reflector 4 (top face of lower part; front face of back part, right face of left part, and left face of right part), a reflecting surface 17 is provided for reflecting light (not shown) radiated from the light emitter of the semiconductor-type light source 3 in a predetermined direction in a predetermined light distribution pattern, for example, in a diffusive light distribution pattern (not shown).

The left part of the closed portion of the reflector 4 is long in forward and backward dimensions in comparison with the right part. In addition, wall portions 18, 19 are integrally provided on one face (front face) of a respective one of the left and right parts of the closed portion of the reflector 4. On the wall portions 18, 19 of the reflector 4, two cylinder portions 20, 21 are integrally provided for the mounting boss portions 9, 10 of the mount member 2 in a backward direction. In the cylinder portions 20, 21, two through holes 22, 23 into which the screws 5 are to be inserted are provided for the mounting boss portions 9, 10 of the mount member 2.

A hollow axle portion 24, which rotatably engages from the outside with the mounting boss portion 9 of the mount member 2, is integrally provided at an edge of one of the through holes 22 of the reflector 4, namely at one end (back end) of the cylinder portion 20. A positioning end face 25 abutting against a front face of the mount portion 6 of the mount member 2, thereby allowing a front-to-back position to be positioned relative to the mount member 2 of the reflector 4, is provided at the hollow axle portion 24. In addition, in the hollow axle 24, three grooves 26 are provided in such a manner that the three ribs 11 of the mounting boss portion 9 of the mount member 2 are positioned, respectively. A width of a respective one of the grooves 26 has a dimension to an extent such that the reflector 4 can rotate in a screw-in (tightening) rotation direction of the screw 5 relative to the mount member 2, when the reflector 4 is mounted on the mount member 2.

Positioning portions for determining a position in the screw-in rotation direction of the screw 5 are provided at the mounting boss portion 10 other than the mounting boss portion 9 with which the hollow axle portion 24 of the mount member 2 engages; and the reflector 4, respectively. In other words, the positioning portion of the mount member 2 is one of the three ribs 12 of the mounting boss portion 10. On the other hand, the positioning portion of the reflector 4 is an arc-shaped rib 27 which is provided on one end face (back end face) of the cylinder portion 21.

The vehicle lighting device 1 of the embodiment is made of the constituent elements as described above, and hereinafter, a description will be furnished with respect to a procedure for mounting the reflector 4 on the mount member 2 having the semiconductor-type light source 3 mounted thereon.

Figure 2:
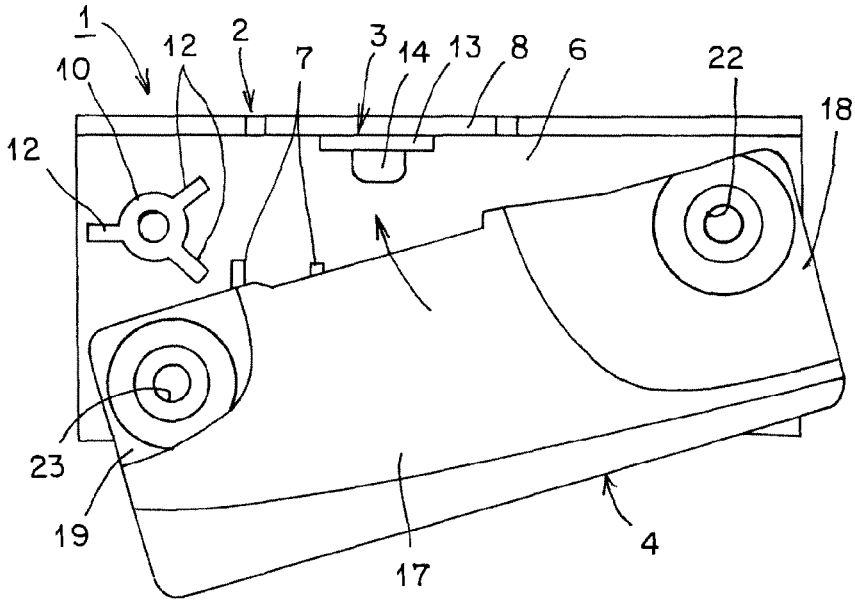
FIG. 2 is a front view (sectional view taken along the line A-A of FIG. 6), showing a state in which a reflector is mounted on a mount member partway, similarly.
Figure 4:
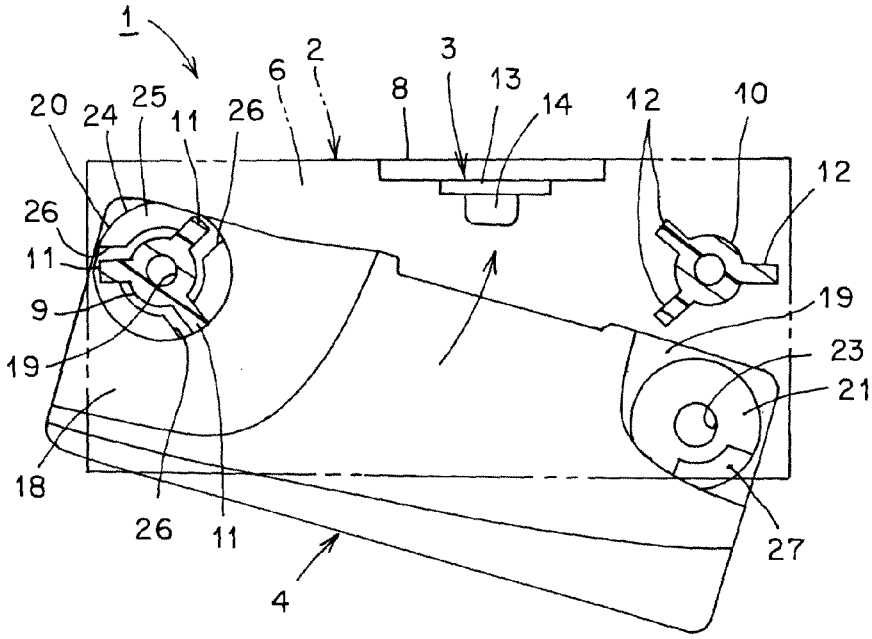
FIG. 4 is a rear view (sectional view taken along the line B-B of FIG. 6), showing a state in which the reflector is mounted on the mount member partway, similarly.

First, as shown in FIGS. 2 and 4, the reflector 4 is inclined against the mount member 2 on which the semiconductor-type light source 3 is mounted. This inclination angle (inclination quantity) is determined to an extent such that the semiconductor-type light source 3 and the reflector 4 are disallowed to be in abutment against each other when the reflector 4 is set to the mount member 2 in one direction (forward direction F). In this state, the hollow axle portion 24 of the reflector 4 is rotatably engaged with the mounting boss portion 9 of the mount member 2 from the outside in one direction (forward direction F) At this time, an end face 25 for the positioning of the hollow axle portion 24 of the reflector 4 is in abutment against a front face of the mount board portion 6 of the mount member 2, allowing a front-to-back position to be determined relative to the mount member 2 of the reflector 4. In addition, the three ribs 11 of the mounting boss portion 9 of the mount member 2 are positioned in the three grooves 26 of the hollow axle portion 24 of the reflector 4, respectively.

Subsequently, one of the through holes 22 of the reflector 4 and one of the mounting boss portions 9 of the mount member 2 are aligned with each other. Next, the reflector 4 is rotated around the hollow axle portion 24 and the mounting boss portion 9 in the direction indicated by arrow in FIGS. 2 and 4. At this time, a width of a respective one of the three grooves 26 at the hollow axle portion 24 of the reflector 4 has a dimension to an extent such that the reflector 4 can rotate in a screw-in (tightening) rotation direction of the screw 5 relative to the mount member 2. Therefore, there is no trouble with rotation of the reflector 4 relative to the mount member 2.

The other one of the through holes 23 of the reflector 4 and the other one of the mounting boss portions 10 of the mount member 2 are then aligned with each other. At this time, the arc-shaped rib 27 of the cylinder portion 21 of the reflector 4 is in abutment against the rib 12 of one of the three mounting boss portions 10 of the mount member 2, allowing a position of the screw-in rotation direction of the screw 5 to be determined relative to the mount member 2 of the reflector 4 (the direction indicated by the arrow drawn in the solid line of FIGS. 3 and 5). In this state, the two screws 5 are inserted into the through holes 22, 23 of the reflector 4, and are threaded in the mounting boss portions 9, 10 of the mount member 2, respectively. The reflector 4 can be thereby mounted on the mount member 2 on which the semiconductor-type light source 3 is mounted.

Figure 6:
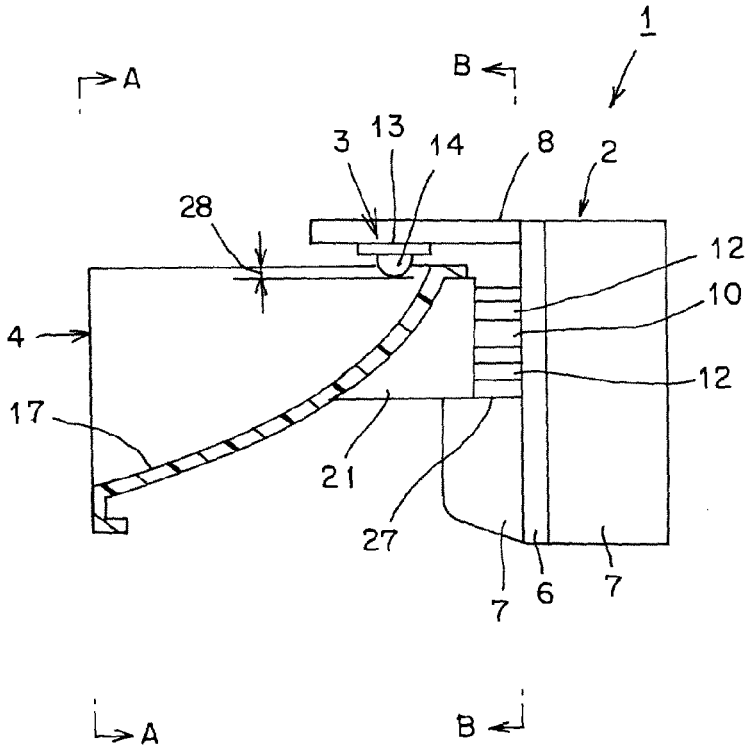
FIG. 6 is a sectional view taken along the line VI-VI of FIG. 3, similarly.
Figure 7:
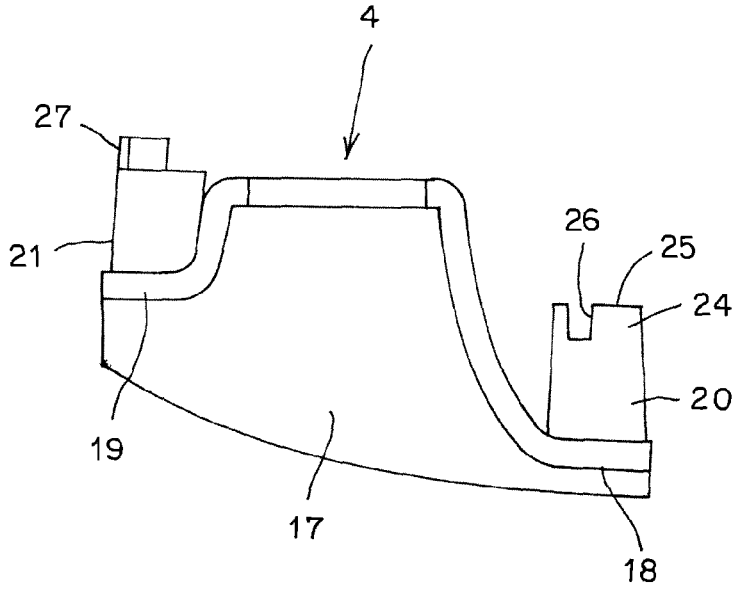
FIG. 7 is a plan view showing the reflector, similarly.

A description will be furnished with respect to a case of: mounting the reflector 4 on the mount member 2 prior to mounting the semiconductor-type light source 3 on the mount member 2; followed by mounting the semiconductor-type light source 3 on the mount member 2 having the reflector 4 mounted thereon. In this case, as shown in FIG. 6, if the reflector 4 is mounted in advance on the mount member 2, a bottom face of the mount visor portion 8 of the mount member 2 is hidden under a cover at a lower part of the closed portion of the reflector 4. Thus, it becomes impossible to mount a bottom face of the board 9 of the semiconductor-type light source 3 in a downward direction on a bottom face of the mount visor portion 8 of the mount member 2. As a result, there is a need to mount the semiconductor-type light source 3 on the mount member 2, and thereafter, mount the reflector 4 on the mount member 2 having the semiconductor-type light source 3 mounted thereon.

The vehicle lighting device 1 of the embodiment is made of the constituent elements as described above, and hereinafter, functions of these constituent elements will be described.

First, the light emitter of the semiconductor-type light source 3 is lit to emit light. Afterwards, the light radiated from the light emitter of the semiconductor-type light source 3 is reflected on a reflecting surface 17 of the reflector 4 in a predetermined direction in a predetermined light distribution pattern, for example, in a diffusive light distribution pattern, and the reflected light is then illuminated to the outside.

The vehicle lighting device 1 of the embodiment is made of the constituent elements and functions as described above, and hereinafter, advantageous effect(s) thereof will be described.

Figure 8:
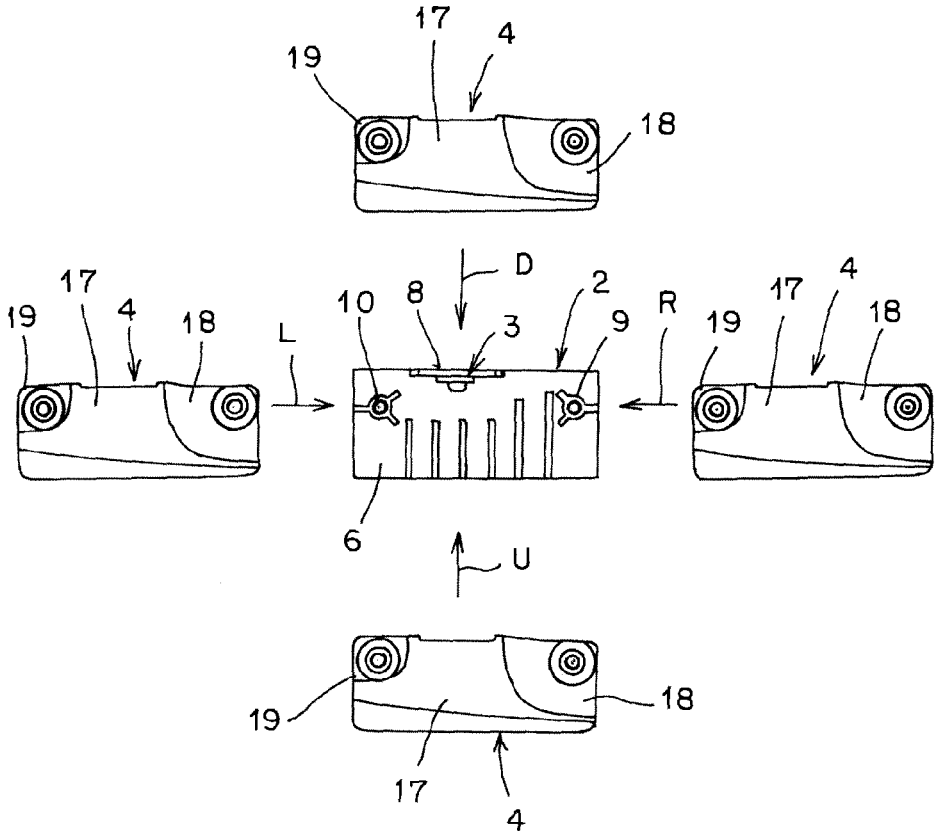
FIG. 8 is a cross-sectional explanatory view taken along the line A-A of FIG. 6, showing four directions (upward, downward, leftward, and rightward directions) in which the reflector cannot be mounted on the mount ember, similarly.
Figure 9:
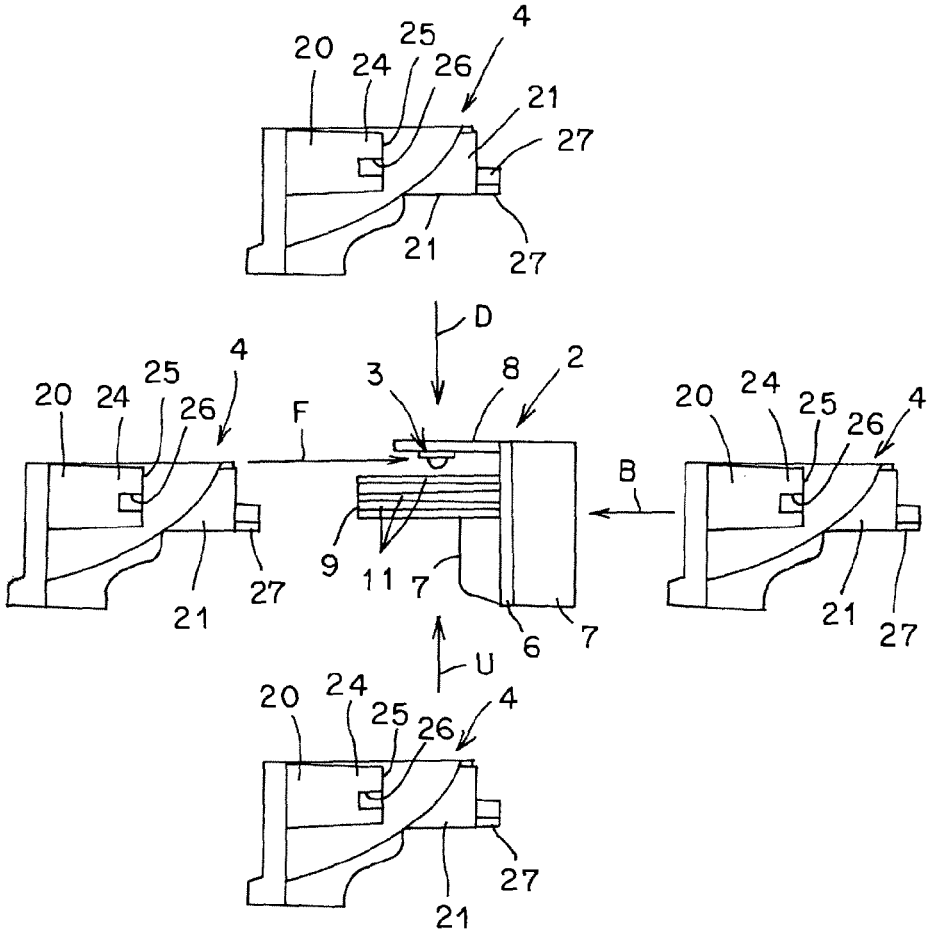
FIG. 9 is an explanatory side view showing three directions (upward, downward, and backward directions) in which the reflector cannot be mounted on the mount member and one direction (forward direction) in which the reflector can be mounted on the mount member, similarly.

The vehicle lighting device 1 of the embodiment, as shown in FIGS. 8 and 9, is structurally incapable of mounting the reflector 4 in five directions (upward direction U, downward direction D, leftward direction L, rightward direction R, backward direction B) on the mount member 2 having the semiconductor-type light source 3 mounted thereon. For example, in the upward direction U, it is impossible to mount the reflector, since the mounting boss portion 9 of the mount member 2 and the hollow axle portion 24 of the reflector 4 are in abutment against each other. In the downward direction D, it is possible to mount the reflector, since the mount visor portion 8 of the mount member 2 and a lower part of the closed portion of the reflector 4 are in abutment against each other. In the leftward direction L, it is impossible to mount the reflector, since the mounting boss portion 9 of the mount member 2 and the hollow axle portion 24 of the reflector 4 are in abutment against each other and the semiconductor-type light source 3 mounted on the mount visor portion 8 of the mount member 2 and a left part of the closed portion of the reflector 4 are in abutment against each other. In the rightward direction R, it is impossible to mount the reflector, since the mounting boss portion 9 of the mount member 2 and the cylinder portion 21 of the reflector 4 are in abutment against each other and the semiconductor-type light source 3 mounted on the mount visor portion 8 of the mount member 2 and a right part of the closed portion of the reflector 4 are in abutment against each other. In the backward direction B, it is impossible to mount the reflector, since the mount board portion 6 of the mount member 2 and the reflector 4 are in abutment against each other. On the other hand, it is possible to mount the reflector in one direction (forward direction F). In addition, as shown in FIG. 6, when the reflector 4 is mounted in one direction (forward direction F) on the mount member 2 having the semiconductor-type light source 3 mounted thereon, an overlap portion 28 exists between the semiconductor-type light source 3 and the reflector 4.

According to the vehicle lighting device 1 of the embodiment, in the vehicle lighting device that conforms to the foregoing condition, when the reflector 4 is mounted on the mount member 2 having the semiconductor-type light source 3 mounted thereon, the reflector 4 can be mounted on the mount member 2 without the semiconductor-type light source 3 and the reflector 4 interfering with each other. In other words, according to the vehicle lighting device 1 of the embodiment, when the reflector 4 is mounted in one direction (forward direction F) on the mount member 2 having the semiconductor-type light source 3 mounted thereon, the reflector 4 is inclined against the mount member 2 having the semiconductor-type light source 3 mounted thereon, as shown in FIGS. 2 and 4, so as to disallow the semiconductor-type light source 3 and the reflector 4 to interfere with each other. In this state, the hollow axle portion 24 of the reflector 4 is rotatably engaged with the mounting boss portion 9 of the mount member 2 from the outside in one direction (forward direction F). Subsequently, one of the through holes 22 of the reflector 4 and one of the mounting boss portions 9 of the mount member 2 are aligned with each other. Next, while the reflector 4 is rotated around the hollow axle portion 24 and the mounting boss portion 9 in the direction indicated by the arrow of FIGS. 2 and 4, the other one of the through holes 23 of the reflector 4 and the other one of the mounting boss portions 10 of the mount member 2 are aligned with each other. In this state, two screws 5 are inserted into the through holes 22, 23 of the reflector 4, and are threaded into the mounting boss portions 9, 10 of the mount member 2. The reflector 4 can be thereby mounted on the mount member 2 having the semiconductor-type light source 3 mounted thereon, without the semiconductor-type light source 3 and the reflector 4 interfering with each other.

In addition, according to the vehicle lighting device 1 of the embodiment, by means of the positioning end face 25 which is provided at the hollow axle portion 24 of the reflector 4, in a state in which the hollow axle portion 24 is rotatably engaged with the mounting boss portion 9 of the mount member 2 from the outside, if the reflector 4 is pushed into the mount member 2 in one direction (forward direction), the positioning end face 25 of the hollow axle portion 24 of the reflector 4 becomes in abutment against a base of the mounting boss portion 9 of the mount member 2, namely a front face of the mount board member 6, and positions of the reflector 4 and the mount member 2 in one direction (forward direction F) are determined. As a result, the vehicle lighting device 1 of the embodiment allows the reflector 4 to be mounted, with high precision, on the mount member 2 having the semiconductor-type light source 3 mounted thereon.

Figure 3:
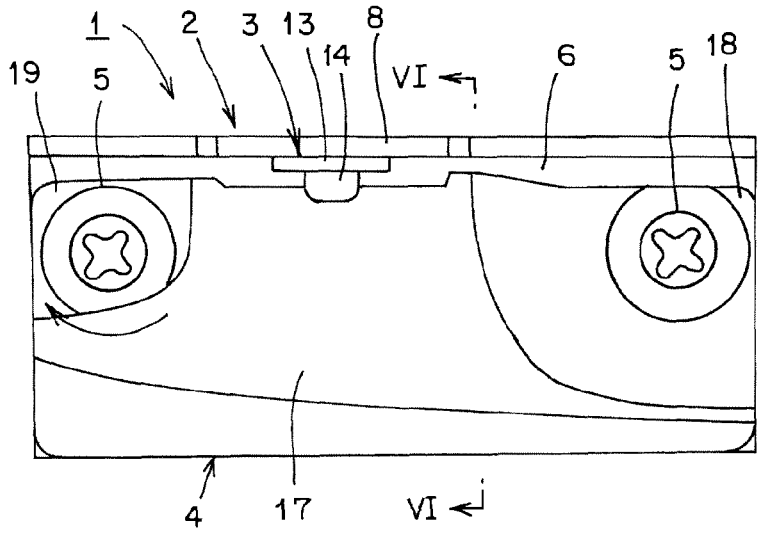
FIG. 3 is a front view (sectional view taken along the line A-A of FIG. 6), showing a state in which the reflector is completely mounted on the mount member, similarly.
Figure 5:
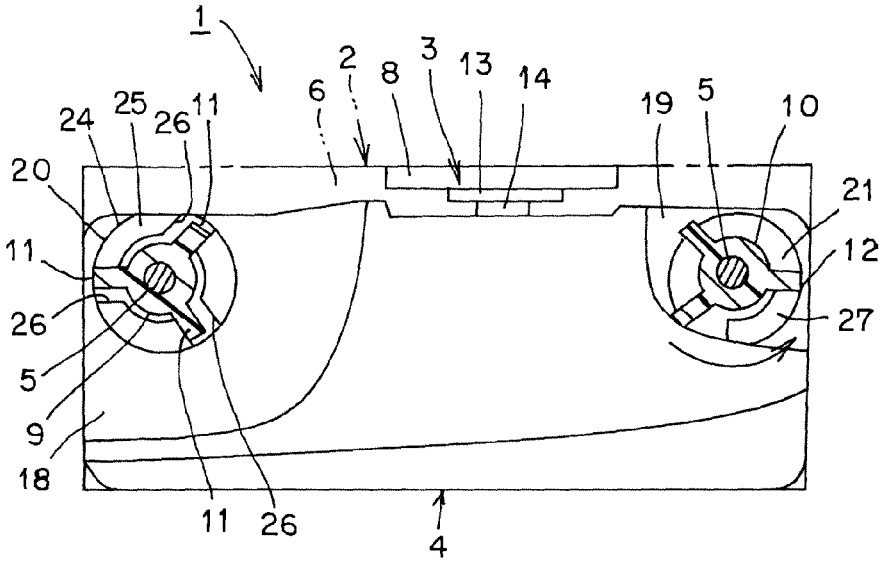
FIG. 5 is a rear view (sectional view taken along the line B-B of FIG. 6), showing a state in which the reflector is completely mounted on the mount member, similarly.

Further, according to the vehicle lighting device 1 of the embodiment, by means of the positioning portions provided at a mounting boss portion 10 other than the mounting boss portion 9 with which the hollow axle portion 24 engages; and the cylinder portion 21 of the reflector 4, respectively, namely by means of one of three ribs 12 of the mounting boss portions 10 and the arc-shaped rib 27 of the cylinder portion 21, when the screw 5 is inserted into the through hole 21 of the reflector 4 and is threaded into the mounting boss portion 10 of the mount member 2, the positioning portion of the reflector 4, namely the arc-shaped rib 27 of the cylinder portion 21 is in abutment against the positioning portion of the mounting boss portion 10 of the mount member 2, namely one of the three ribs 12 in the screw-in (tightening) rotation direction of the screw 5 (the direction indicated by the arrow drawn in the solid line of FIGS. 3 and 5), and positions of the reflector 4 and the mount member 2 in the screw-in (tightening) rotation direction of the screw 5 are determined. As a result, the vehicle lighting device 1 of the embodiment allows the reflector 4 to be mounted, with high precision, on the mount member 2 having the semiconductor-type light source 3 mounted thereon.

The foregoing embodiment described provision of the two boss portions 9, 10 of the mount member 2 and the two through holes 22, 23 of the reflector 4, whereas in the present invention, there may be provision of three or more boss portions of the mount member 2 and three or more through holes of the reflector 4.

The foregoing embodiment described provision of the reflecting surface 17 of the reflector 4 intended to reflect the light from the semiconductor-type light source 3 in a diffusive light distribution pattern, whereas in the present invention, there may be provision of a reflecting surface of the reflector 4 intended to reflect the light in a light distribution pattern other than the diffusive light distribution pattern.

What is claimed is:

1. A vehicle lighting device, comprising:

(i) a mount member;

(ii) a semiconductor-type light source which is mounted on the mount member;

(iii) a reflector which is mounted on the mount member, the reflector having a reflecting surface for reflecting light from the semiconductor-type light source in a predetermined direction in a predetermined light distribution pattern; and (iv) at least two screws for mounting the reflector on the mount member by threading the screws into the mount member in an identical direction via the reflector, wherein:

at least two mounting boss portions into which the screws are to be threaded are provided at the mount member;

at least two through holes into which the screws are to be inserted are provided for the mounting boss portions at the reflector; and a hollow axle portion which rotatably engages with at least one of the mounting boss portions from an outside is provided at an edge of at least one of the through holes of the reflector.

2. The vehicle lighting device according to claim 1, wherein:

a positioning end face abutting against the mount member to thereby determine a position of the reflector relative to the mount member is provided at the hollow axle portion.

3. The vehicle lighting device according to claim 1, wherein:

positioning portions for determining positions in a screw-in rotation direction of the screws are provided at the mounting boss portion other than the mounting boss portion with which the hollow axle portion engages and at the reflector, respectively.

4. A vehicle lighting device, comprising:

(i) a semiconductor-type light source;

(ii) a heat sink member on which a mount visor portion having the semiconductor-type light source installed on a surface thereof and a respective one of first and second mounting boss portions are protruded in a predetermined direction; and (iii) a reflector which is mounted on the heat sink member in the predetermined direction, the reflector having a reflecting surface including an overlap portion between the reflector and the semiconductor-type source installed on the mount visor portion, in a case where the reflector is directly seen in a direction orthogonal to the predetermined direction when the reflector is mounted on the heat sink, the reflecting surface being adapted to reflect light emitted from the semiconductor-type light source installed on the mount visor portion, as reflection light, the reflector including:

through holes which are provided at positions corresponding to the first and second mounting boss portions of the heat sink member and into which screws are to be inserted; and a hollow axle portion which is provided at an edge of either of the through holes and is adapted to rotatably engage with either of the first and second mounting boss portions of the heat sink member from an outside, in a state in which the reflector is inclined against the heat sink member.

5. The vehicle lighting device according to claim 4, wherein:

a positioning end face, abutting against the mount member to thereby determine a position of the reflector relative to the mount member, is provided at the hollow axle portion of the reflector.

6. The vehicle lighting device according to claim 4, wherein:

positioning portions for determining positions in a screw-in rotation direction of the screws are provided at the mounting boss portion other than the mounting boss portion with which the hollow axle portion engages and the reflector, respectively.

7. The vehicle lighting device according to claim 4, wherein:

the reflector has a cylinder portion, which is provided for the first and second mounting boss portions of the heat sink member, on a face opposite to the reflecting surface of the reflector; and the through hole of the reflector is formed in the cylinder portion.

* * * * *